US010300363B2

(12) United States Patent
Ramirez

(10) Patent No.: US 10,300,363 B2
(45) Date of Patent: May 28, 2019

(54) GOLF GLOVES

(71) Applicant: John C. Ramirez, Redlands, CA (US)

(72) Inventor: John C. Ramirez, Redlands, CA (US)

( * ) Notice: Subject to any disclaimer, the term of this patent is extended or adjusted under 35 U.S.C. 154(b) by 242 days.

(21) Appl. No.: 15/229,123

(22) Filed: Aug. 5, 2016

(65) Prior Publication Data

US 2016/0339325 A1 Nov. 24, 2016

Related U.S. Application Data

(63) Continuation of application No. 14/018,432, filed on Sep. 5, 2013, now Pat. No. 9,457,258.

(51) Int. Cl.

| | |
|---|---|
| ***A63B 71/00*** | (2006.01) |
| ***A63B 71/14*** | (2006.01) |
| ***A63B 57/20*** | (2015.01) |
| ***A63B 57/30*** | (2015.01) |
| *A63B 71/06* | (2006.01) |

(52) U.S. Cl.

CPC ..... *A63B 71/146* (2013.01); *A63B 57/207* (2015.10); *A63B 57/353* (2015.10); *A63B 2071/0655* (2013.01)

(58) Field of Classification Search

CPC ... A63B 71/146; A63B 57/207; A63B 57/353; A63B 2071/0655

See application file for complete search history.

(56) References Cited

U.S. PATENT DOCUMENTS 1,358,824 A * 11/1920 Burden ..... A41D 19/015 2/161.8
3,387,306 A * 6/1968 Korey ..... A63B 71/146 2/159
3,394,408 A * 7/1968 Bush ..... A63B 71/146 2/159
4,131,952 A * 1/1979 Brenning, Jr. ..... A41D 19/015 2/124
5,228,142 A * 7/1993 Yoswein-McGreen ..... A61F 13/10 2/159
6,154,885 A * 12/2000 Kobayashi ..... A63B 71/146 2/161.2
6,279,163 B1 * 8/2001 Hale ..... A63B 21/065 2/160
6,427,248 B1 * 8/2002 Albert ..... A41D 19/01558 2/161.1
6,651,255 B1 * 11/2003 Schild ..... A41D 19/02 2/160
2003/0208833 A1 * 11/2003 Gold ..... A41D 19/02 2/161.1
2004/0025224 A1 * 2/2004 Albert ..... A63B 71/148 2/159
2006/0150356 A1 * 7/2006 Tayler ..... A47L 13/18 15/227

(Continued)

*Primary Examiner* — Khaled Annis

(57) ABSTRACT

According to the various features characteristics and embodiments of the present invention which will become apparent as the description thereof proceeds, the present invention provides improvements to partially fingered gloves intended to increase the overall performance in sports activities including but limited to golf. The improvements of said gloves primarily comprising grip enhancers on the dorsal portion of these gloves, on the side or sides of any existing digital segments, or any combination thereof.

19 Claims, 10 Drawing Sheets

(56) References Cited

U.S. PATENT DOCUMENTS

| | | | | |
|---|---|---|---|---|
| 2010/0186140 | A1* | 7/2010 | Ramirez | A41D 19/0017 2/161.1 |
| 2012/0137401 | A1* | 6/2012 | Ramirez | A63B 71/141 2/161.1 |

* cited by examiner

The interlocking grip (RELATED ART)

GOLF GLOVES

This is a Continuation to application Ser. No. 14/018,432, a pending application.

FIELD OF THE INVENTION

The present invention relates to sports apparatus and equipment, and uses thereof, used in playing the game of various sports. The present invention and its glove embodiments enhance the overall performance in athletic tasks and/or execution commonly associated during sports play, particularly in, but not limited to golf by configuring to meet the specific requirements of a user who plays the sport of golf using the conventional interlocking golf grip, for example. The present invention unique finger configurations generally enclose the thumb as well as the middle, ring and pinkie fingers of a user's hand, including the fingertips. Furthermore, these gloves are configured to leave uncovered at least a portion of the distal phalanx of a user's forefinger. The improvement of said gloves comprising grip enhancers on the dorsal portion of these gloves, on the side or sides of any existing digital segments, or any combination thereof.

BACKGROUND OF THE INVENTION

An important goal in playing sports is to win. Often that means proper play execution, good ball control, good grip and feel, and proper form in the sports fundamentals. Gloves and other types of hand covers are permitted in most sports. Many individuals use gloves to enhance, in some way, their competitive edge. Indeed, gloves have become so important that different types of gloves have been created for different sports. Even within a sport, different types of gloves have been invented to, among other things, maximize performance in specific tasks.

The use of gloves can increase performance especially when the user needs to grip an object like a ball or golf club, for example. Although generally useful, using prior art conventional gloves in some sports can come with significant drawbacks, especially if a user must use their hands to feel in addition to simply grip an object.

In Golf for example, a golfer grabs a golf club with both hands, and must use his or her hands to grip as well as 'feel' the golf club throughout the golf swing. This ability to feel is critical when swinging a golf club. Once a golfer begins a golf swing, the golfer cannot not lose sight of the golf ball until impact occurs with the golf ball. Consequently, the golfer must use tactile sensations on the hands to feel if the golf club is on the correct swing plane throughout the golf swing. Once the golf swing begins, the golfer can no longer look at the golf club and must continue to look at the golf ball.

This need to feel the golf club with a hand has therefore resulted in golfers having to make a difficult choice. Although clearly these players would benefit from added grip enhancers on their hand to increase their control and accuracy, prior art gloves have forced a golfer to choose between all feel and no feel.

Playing the sport of golf without the help of gloves, however, can also be an inferior choice. Quite often a golfer's success requires swinging the golf club to produce significant club speed, especially when teeing off at the beginning of each hole. As the velocity of the golf club increases, it becomes increasingly more difficult to maintain a tight grip on the club; this is especially true at the point of impact with the golf ball. Virtually all active golfers have chosen therefore to enhance grip capabilities and therefore sacrifice the ability to better feel the golf club.

Golfers have generally decided to wear a glove on their weak-hand, thereby increasing the overall grip of the weak hand but, because prior art weak-hand golf gloves are full fingered and therefore cover all of the user's fingers, the weak hand loses significant tactile capabilities. Cognizant of this major deficiency, most golfers will not wear a glove on their dominant hand, presumably to compensate for the loss of tactile sensation from wearing a glove on their weak-hand.

Although this method of gripping a golf club, by wearing only one golf glove, does provide some tactile sensation, the tactile sensation is limited to only the dominant hand so that the weak hand loses significant tactile sensations. This limitation of only allowing skin contact by the dominant hand has often resulted in several problems such as: difficulty in weak-hand and dominant hand coordination because skin contact between hands is blocked by the glove; difficulty in assessing proper golf club positioning by the weak-hand throughout the golf swing; and difficulty in getting proper feedback from weak-hand sensations if one completes an improper golf swing.

An additional concern with prior art is not configuring golf gloves that meet the different requirement, based on a user's preferred golf grip.

One very popular golf club grip, for example, is called the interlocking grip. When you use this grip, the forefinger of the golfer's weak-hand is placed over and wrapped around the strong (dominant) hand's pinkie finger. With this grip, clearly the role of the interlocked fingers has as much to do with grip as it does with coordination and feel between the user's two hands to more effectively control the golf swing and to provide greater overall golf swing consistency. There is, therefore, no real need to cover all of the weak hand's forefinger, which touches the dominant hand's interlocked pinkie finger, and uncovering at least part if not all of the forefinger would actually significantly increase overall coordination by allowing the now uncovered portion of the weak hand's forefinger to touch the skin of the dominant hand's pinkie finger.

Only most recently have gloves attempted to be configured to meet the basic needs for golfers using the interlocking grip by leaving at least partially uncovered the forefinger of a user's weak hand thereby providing added tactile sensations on the weak hand's interlocking forefinger.

Whereas users of these partial-fingered gloves now have greatly improved tactile sensations on the weak hand's interlocked forefinger, no improvements have been made to increase the grip of the strong hand's interlocked pinkie finger, a vital ingredient to maximizing overall hand coordination and golf swing using the interlocked grip method.

Most conventional golf gloves, for example, have ventilation recesses along the dorsal portion of the digital segments including on the forefinger which of course can be counterproductive and problematic especially when gripping a golf club using the interlocking grip. Conventional golf gloves provide recesses on the proximal phalanx of the forefinger which of course channel perspiration to this area, albeit small amounts. This is problematic because the strong hand's pinkie finger interlocks and resides over the forefinger's proximal phalanx. Intentionally trying to channel moisture to this interlocked area will clearly cause unnecessary slipping between the two interlocked fingers and further hinder the user's ability to perform a unison, coordinated golf swing.

Solving these unrecognized problems, as embodiments of the present invention provides, will go a long way to significantly enhance consistent golf swing control, especially during hotter weather conditions. Some embodiments include a forefinger segment without any moisture management recesses along the proximal phalanx on the forefinger segment and/or along portions of the middle finger segment, where the strong hand's pinkie finger usually rests on the weak hand.

Providing a more strategic grip management system will create a firmer contact between the fingers of both hands, and therefore a more controlled golf swing for those using the interlocking grip.

There is also a long existing need for a device that could offer better hand coordination between a golfer's strong hand and weak hand without significantly diminishing a golfer's ability to adequately grip the golf club. Golfers often have to fight completing a 'slice.' When a golfer hits a slice, the golf ball flies to the far outside (far right for a right-handed golfer or far left for a left-handed golfer).

A slice can take place for several reasons. One reason has to do with the dominant hand not moving at the same rate and angle as the weak hand during a golf swing, or not unhinging at the same time. If there is even the slightest separation between the two hands during the golf swing, the club face will not be square at impact; the resulting open face impact will inevitably result in a slice.

An ideal location to minimize hand separation is clearly around and between the two interlocked fingers.

Currently, the ungloved strong hand's pinkie finger has no real targeted, stabile material where it could reasonably maintain a firm hold as a golf club moves over 100 miles per hour, through impact. Prior art dorsal segments—or the back of gloves—are intended for protection and without recognition of the need for providing some added grip support.

Consequently, users with prior art partial fingered gloves will have an unstable pinkie finger grip, especially when dealing with moisture, through harsh climate or from perspiration on the pinkie finger. This slipping, even slight, can result in some separation or delay in hand motion, the results would of course be disaster on a golfer score card.

Embodiments of the present invention would therefore offer significant improvements to prior art by offering strategically placed grip enhancing improvements to gloves tailored especially for users who grip a golf club using the conventional interlocking method—gloves which leave at least the fingertips of the forefinger uncovered on the weak hand of a user.

The present invention will provide a glove for the weak hand whereby the user may both better grip a golf club as well as maintain enhanced tactile sensitivities on parts of the otherwise gloved hand, and simultaneously enhancing grip capabilities by providing strategically positioned grip enhancers for the interlocked pinkie finger.

According to the website by GOLDSMITH, many golfers choose the interlocking grip instead of the Overlapping Grip Method because they desire greater unity in their golf swing, because they have relatively smaller hands, or because they have weaker hands and need added grip. Thus, providing even greater grip potential for those using the interlocking grip method, as the present invention provides, would certainly be welcome. "A common reason players choose one grip over another is their desire to create unity between their hands. When you swing your club, your wrists act as a hinge. However, if your hands become separated during the swing, each wrist can act separately and your hands can interfere with each other."

The article goes on to state that '[Jack] Nicklaus said that he had relatively small hands, and that the interlocking grip allowed him to get a better grip with them. The more-common Vardon grip works better for players with large hands, since one of the fingers on the right hand has to wrap around the fingers of the left hand. With the interlocking grip, all of the fingers are close to the actual cushioned grip. Even the two interlocked fingers don't cause large gaps underneath. Nicklaus also recommends the interlocking grip for players with weak hands. When your interlocked hands wrap around that cushioned grip, the club is locked in place with very little effort."

Providing a solution to better solve these issues could, among other things, allow for greater golf swing control and consistency by providing a golfer with significantly enhanced support for a golfer's dominant (strong) hand grip and weak hand coordination requirements.

The present invention solves the above mentioned problems by, among other things, providing significant improvements to partially uncovered fingered gloves and providing significant grip support on critical areas on or around the interlocked fingers.

DETAIL DESCRIPTIONS OF THE INVENTION

The present invention provides a glove having dorsal (back) and palmar (front) portions for overlaying respective back and palm regions of a human hand, and dorsal and palmar portions having distal and proximal ends with a plurality of digital segments (or stalls) projecting from said distal ends. The digital segment of the thumb covers the thumb including the fingertip of said thumb of a user, the digital segment of the middle finger covers the middle finger including the fingertip of said middle finger of a user, the digital segment of the ring finger covers the ring finger including the fingertips of said ring finger of a user, and the digital segment of the pinkie finger covers the pinkie finger including the fingertip of said pinkie finger of a user.

Additionally, at least a portion of a user's forefinger's distal phalanx will be uncovered.

In one preferred aspect, a forefinger digital segment exists whereby only the forefinger's distal phalanx is uncovered, in its entirety, therefore a forefinger segment will exist on the embodiment that covers a user's proximal and middle phalanges, in their entirety.

In another embodiment, a user's forefinger is completely uncovered, therefore no forefinger segment will exist in the embodiment.

Preferably, at least a portion of the forefinger's proximal phalanx is covered, therefore a forefinger segment will exist that covers at least a portion of a user's proximal phalanx and leaves uncovered at least a portion of the distal phalanx of said forefinger such that the fingertips would be exposed to have heightened tactile sensitivities.

The improvement of said gloves comprises a grip enhancing means on the dorsal portion of these gloves, on the side or sides of any existing digital segments, or any combination thereof.

For example, a grip enhancing means may be provided on the dorsal portion of any existing forefinger segment, preferably generally on its proximal phalanx but extending as far as its metacarpophalangeal joint; a grip enhancing means on the side of any existing forefinger segment, adjacent to the middle finger segment; a grip enhancing means on the side of any existing forefinger segment, adjacent to the thumb segment; a grip enhancing means on the region between the middle finger segment and a user's forefinger (or forefinger segment), extending as far down the dorsal portion to include the forefinger and middle finger segment's metacarpophalangeal joints, and the area in between said joints (but not extending beyond said joints).

Embodiments may also comprise a grip enhancing means on any palmar segment of the glove.

Accordingly, embodiments provide a novel glove that takes into account a user's preferred golf grip, particularly the interlocking grip, for example, by allowing the interlocked and ungloved strong hand's pinkie finger to better grip the non-dominant (weak) hand thereby creating significantly more stable, solid interlocked hands throughout a golfer's swing.

The grip enhancing means can therefore be specifically positioned to provide enhanced grip and a higher coefficient of friction along select areas of the dorsal, side and palmar portions of the glove. The grip enhancing means will offer a golfer multiple benefits such as increased control of a ball or device thereby enhancing performance and overall success at performing a sports task.

Of course, users may prefer any grip enhancing means combinations of the aforementioned.

In at least one embodiment all of the above mentioned areas will comprise of a grip enhancing means.

For example, an embodiment can comprise of a grip enhancing means overlaying the entire proximal and middle phalanges of the forefinger segment, which would include—and be bounded by—the dorsal, palmar and sides of the forefinger's proximal and middle phalanges segment. This area would then include, for example, a high friction surface or a textured surface, as the grip enhancing means. The grip enhancing means could be comprised of a beaded surface pattern, for example, projecting out at least millimeter or so, and which could be integral to the glove material, preferably extending throughout the entire designated surface area, but could certainly extend out to overlay the forefinger metacarpophalangeal joint.

In general, the grip enhancing means of the present invention may be integral to the glove, may be in the form of inserts, or may be affixed to the glove surface by, for example, forming a grip enhancing panel and applying the panel onto a portion of the glove. The grip enhancing means of an embodiment could comprise, for example, a high friction textured surface with a more narrow width, say about 1.5 to three centimeters. This and other embodiments may include a plurality of projections on the surface as the gripping means which is formed from, for example, one of a vinyl material, a rubber material, or a neoprene material, creating a grip enhancing panel.

The material forming the panel could then be applied to a finger segment, for example, using any standard bonding methods, such as adhesion or stitching. The projections can preferably be provided, for example, on at least one—or only on one—phalanx of any forefinger segment. The projections could preferably extend out less than 1/10 of a centimeter, but could range generally from 1/20 of a centimeter to several centimeters.

In general, the panel may preferably be formed from an elastic material or fabric, including but not limited to, a knitted fabric, for example, LYCRA, rayon, neoprene, a rubber material, a vinyl material, or the like. Once the grip enhancing surface on the panel has been formed, the panel may then be applied to the surface of the glove by any standard methods, such as by stitches or adhesives, for example.

The grip enhancing means can also be formed on the glove by any standard method, for example, by embossing, stamping or molding a portion of the glove to create the gripping means. For example, the grip enhancing means can comprise of regular projections of say, about 300 micrometers in height, but may vary in height depending on preference. The projections may all be the same height, and may be in rows. They may be embossed elongated shapes that are interconnected, thus creating a high coefficient of friction throughout the entire palmar surface area of the glove. Other embodiments could of course offer different heights, non-uniform heights, and have a more random pattern on the palmar portions forming the glove.

The grip enhancing means can also be inserted on the glove by any standard method, for example, by providing a textured fabric component of which the surface inserts are made, and securing this material to the glove by sewing this material to select areas of the glove in place of the glove material.

In general, the grip enhancing means of the present invention generally creates a higher coefficient of friction than the surrounding portion on the glove, and can be comprised of various grip-enhancing materials, forms, coatings, and designs, including but not limited to, foams, fabrics, PVC dots, perimeter patching designs, linear and non-linear grooves, or combinations thereof, high friction surfaces, textured surfaces, a plurality of regular or irregular projections, a plurality of regular or irregular depressions, non-slip materials and coatings, such as PVC coatings, nitrile coatings and latex coatings, and designs creating coarse surfaces such as eighty grit Emory cloth for example, as well as pebbled or beaded surfaces, convex or concave bumps, striations, cross-hatches, convex or concave linear and non-linear lines, angled ribs, random structures, convex or concave ridges, crevices, elongated segments, and the like. Preferably, the depths of the depressions and/or heights of projections would be such that the gap formed by the depressions or projections would allow for some movement of the glove surface areas thereby increasing the grip capabilities of the user. The height or depth ranges can generally begin at about 100 micrometers to several millimeters or more.

The grip enhancing means may further comprise a plurality of spaced apart stripes or striped projections formed from a high friction material, such as a PVC material, for example. Preferably the stripes comprise raised or projecting stripes and may be arranged to extend generally parallel to the axis of any existing finger stalls. Stripes and other forms may be uniformly spaced or spaced at varying intervals. Similarly, stripes and other forms may have varying thicknesses, heights or depths, depending on preference. The thickness ranges generally can begin at about 100 micrometers to several millimeters or more. The grip enhancing means may create a pattern, may be in rows or randomly placed, and may form circular and non-circular shapes, such as spherical, cylindrical or elongated. Additionally, they may be individually separated or interconnected.

The grip enhancing means should preferably provide an effective coefficient of friction, preferably of at least a Shore A Durometer of about two or greater.

Accordingly, embodiments provide a novel glove with added grip-enhancing features that enhance overall control and sports performance.

Embodiments may also offer a liner which may be integrally formed on the glove. For example, the liner (or sleeve) could be attached to the glove by standard methods, such as by conventional stitching about the perimeter of the dorsal segment.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing or practicing in colder conditions or when playing at night, which is beginning to gain in popularity. Liners may also provide support against chapped hands by providing a liner infused with aloe versa, as can be standard in non-sport gloves.

It will be apparent to one of ordinary skill in the art that many other implementations of liners are possible.

In yet another aspect, embodiments may also comprise an aperture along the middle finger digital segment of the glove. The aperture will generally leave uncovered at least a portion of the middle finger segment's proximal phalanx. The aperture resides generally along the proximal phalanx, thereby defining its general boundaries. Within this parameter the location of the aperture (e.g., only on the side of the proximal phalanx or primarily of the top dorsal portion) along the middle finger segment will vary due to user preference and sport being played. These embodiments, coupled with the improvements described herein, will also offer an additional significant feature to greatly enhance golf swing performance and hand swing coordination.

The aperture on the middle finger segment could be located to leave uncovered about the top half of the proximal phalanx, for example, thus creating one rather large aperture. This finger configuration will allow a golfer to increase their overall control of a golf swing.

When the golfer uses the interlocking grip and places the Pinkie finger of his/her dominant hand around and between the uncovered forefinger and covered middle finger of his weak-hand, the coordination from the added feel between the two hands will be enhanced with this embodiment. As the strong hand's pinkie finger wraps around and embraces the covered weak hand's covered forefinger's proximal phalanx, the pinkie finger would abut and also touch the skin of the weak hand's middle finger because of the embodiment's aperture along the middle finger segment. The pinkie finger's distal phalanx, or the fingertips, would however have increased grip capabilities by the present invention. Providing projections in the form of ridges, for example, on the dorsal segment of the interlocked forefinger's proximal phalanx, would allow the pinkie finger's fingertip with the ability to better maintain a solid, stable grip throughout a golf swing.

Accordingly, embodiments can also provide a novel glove with features that can simultaneously assist a golfer improve hand coordination by allowing the skin of the weak hand's middle finger to touch the skin of the strong hand's pinkie finger, while increasing grip on and around the interlocked fingers was well.

Among the benefits of this unique configuration include heightened critical tactile sensitivities to more properly feel if there is any separation between the weak hand's middle finger and the dominant hand's pinkie finger, throughout the golf swing. In addition, these embodiments should also diminish concern for those golfers who eschew the interlocking grip method because it may seem uncomfortable or awkward to them.

Embodiments may also have an expandable opening means at a wrist end adapted to receive the user's hand. This may comprise of a wrist portion with a securement opening means, such as but not limited to a flap which mechanically engages a flap capture mechanism to secure the glove to the users hand (e.g., a synthetic hook and loop fastening interface which adheres when pressed together, commonly using VELCRO). In this case the flap could overlay a small slit or opening along a portion of the back of the glove to allow the glove to widen when a user places the glove onto the hand. The opening means may comprise of other standard used mechanisms of allowing a user to apply and disengage the glove, including but not limited to an elastic band material along the wrist portion, or combinations therebetween.

Embodiments may also comprise of micro-recesses along any portions of the glove, generally used on golf gloves and baseball gloves for ventilation or moisture management purposes. These micro recesses are generally about 0.120 millimeters or so in diameter. These micro recesses are generally not along the proximal phalanx of the middle finger segment or the proximal phalanx of the forefinger, although some embodiments may be configured as such to meet user conventional preferences. Alternatively or additionally, recesses may reside on the glove portion overlaying one or more metacarpophalangeal joints. In at least one embodiment, an aperture will reside on a metacarpophalangeal joint segment, such as along the middle finger metacarpophalangeal joint, to provide added ventilation and added flexibility. The aperture on the metacarpophalangeal joint portions will preferably not extend beyond said joint portions, thereby defining their terminal edges.

At least one embodiment will provide micro-recesses along the side of the middle finger segment's proximal phalanx, adjacent the ring finger segment, so to direct moisture away from the interlocked fingers.

Providing a more strategic moisture management system configured for users of the interlocking grip method will add to dryer interlocked hands and therefore more successful golf swings.

The finger segments of embodiments are preferably designed to fit snugly around a user's fingers, as are typical sports gloves. In addition, some embodiments may have material treated by a moisture repellant, for example SCOTCH GUARD or a synthetic resin, extremely useful during harsher weather conditions. Additionally, embodiments may also comprise various weather-resistant and perspirant-resistant materials, forms and designs including, but not limited to, water-resistant materials or micro-recess designs along any portion of the glove, for moisture management, or combinations thereof.

Embodiments may be made and manufactured using standard materials and methods in developing sports gloves. Materials that can comprise these glove embodiments include, but are not limited to, woven materials such as natural, synthetic or blends of natural and synthetic yarns, thermoextruded or thermoset rubbery embodiments such as those made from thermoplastic elastomers. Examples of synthetic yarns include nylon, polyester, and spandex (polyurethane) yarns. Embodiments may also comprise stretch materials and designs, mesh fabrics, recycled and flexible materials, cottons, polyester, rayon, spandex, fleece, leathers and synthetic leathers such as cabretta leather, rubbers, plastics, woven fabrics, non-woven fabrics, cloths, LYCRA, a vinyl material, a neoprene material, a fleece material, COOL MAX fabric, or combinations thereof.

Construction of the present invention may be accomplished by any standard methods, such as, for example, by designing the dorsal and palm sections to meet along a conjoining lateral edge to define a pocket for receiving the eminence of a user's hand. Other standard methods of construction could certainly be used, of course.

One sport that will clearly benefit from the present invention is golf. The present invention will meet an unmet need by significantly and substantially improving prior art gloves for the weak hand. Prior art does not allow a golfer to take complete advantage of his/her preferred grip by allowing not configuring a glove to meet the unique requirements of a golfer using the interlocking grip method, for example, and thereby maximizing hand coordination throughout the golf swing.

The present invention primarily provides significant improvements to golf gloves, especially for those using the interlocking grip method.

Although the basic interlocking grip method is to interlock the weak-hand's forefinger with the strong hand's pinkie finger, there are slight variations as to the exact, or preferred location of where the strong hand's pinkie finger resides. For example, some interlock users place their interlocked pinkie finger mostly between the weak hands forefinger and middle finger. This variation keeps a user's hands firmly and closely together. Other interlock users prefer to overlay their interlocked pinkie finger primarily on top of, or on the dorsal segment of, the forefinger's proximal phalanx. The present invention provides solutions for those variations, and others, for superior effectiveness.

One embodiment that would improve prior art comprises a glove that covers essentially all of the weak-hand's thumb, middle, ring and pinkie fingers, while leaving the forefinger completely uncovered. The improvement comprises a grip enhancing means on the region of the glove that resides generally between the forefinger and the middle finger segment.

The grip enhancing means of this embodiment provides the user with the ability to create a firmer grip on the golf club primarily because the user can use her pinkie finger to better hold onto the weak hand due to the grip enhancing means.

This and other embodiments now allow far greater feel and coordination lost with prior art especially when gripping a golf club using the conventional interlocking grip. The interlocked fingers now allow for far better feedback because both interlocked fingers are now uncovered, making it easier to adjust a golf swing, while simultaneously provided increased grip support for the interlocked pinkie finger's distal phalanx.

The grip enhancing means may comprise a plurality of projections formed from a skid resistant material, such as neoprene, PVC, rubber or the like. The projections can form a pattern on the selected surface area. Preferably, the high friction surface may include interstices or spaces between projections to allow for necessary flexibility. Preferably, the projections can have an average height of about 700 micrometers. Other similar embodiments can have uniform heights of say, 600 micrometers to three or four millimeters or more.

Additionally, this embodiment can have a palmar and dorsal portion overlaying a portion of the wrist area. For example, the wrist portion can be stitched on the glove and be made of an expandable composition whereby the glove expands when being placed on a hand, and then naturally readjusts to fit snugly around the user's wrists.

Finally, this and other embodiments may also provide a detachable ball marker, such a circular magnetic disc that attaches to a magnet located on the dorsal surface area of the golf glove, for example. The ball marker may be secured by any standard fastening means, such as by magnetism or snap fastening, for example. The back portion of the detachable ball marker as well as the connecting dorsal segment of the glove may both therefore have small magnets. The ball marker may be circular or non-circular in design.

An example of another glove embodiment that will provide superior advantages over prior art in the sport of golf, would be to improve a glove that only partially cover the user's forefinger while essentially enclosing the thumb, middle, ring and pinkie fingers.

As previously mentioned, one very popular grip is called the interlocking grip. When you use this grip, the forefinger of the golfer's weak-hand is placed over his dominant hand and is interlocked with the dominant hand's pinkie finger. With this grip, clearly the role of the weak-hand's forefinger has as much to do with grip and more with coordination and feel on the strong-hand, to more effectively control the golf swing and to provide greater golf swing consistency. There is, therefore, no real need to cover all of the weak-hand's Forefinger, and covering the entire forefinger actually diminishes said forefinger's sensitivities. Embodiments of the present invention would offer significant improvements to these glove configurations.

Specifically, for example, this embodiment could comprise a glove that covers essentially all of the weak-hands thumb, middle, ring and pinkie fingers, while leaving the forefinger's fingertips uncovered. A forefinger digital segment would exist whereby all of the proximal and middle phalanges are completely covered. In addition, most of the distal phalanx would be uncovered, say about sixty percent, such that all of the forefinger's fingernail is completely uncovered, and extending around the palmar portion of the forefinger segment.

The improvement comprises a grip enhancing means on the dorsal portion of the forefinger segment, and on both sides of the forefinger segment.

The grip enhanced means of this embodiment provides the user with the ability to create a firmer grip on the golf club primarily because the user can use her pinkie finger to better hold onto the weak hand due to the grip enhanced means along the forefinger's dorsal segment as well as along the side of the forefinger segment, adjacent the middle finger segment.

In addition, providing a grip enhancing means on the side of the forefinger's proximal phalanx, adjacent to the thumb, allows the weak hand's forefinger to establish a better hold on the strong hand's ring finger when they touch, providing a truer connection between the two hands while using the interlocking grip method.

The grip enhancing means may comprise of stripes, for example, projecting out about 600 micrometers, for example.

Users who prefer this embodiment will greatly benefit from significantly increased feel between the uncovered portions of the interlocked fingers of both hands, while still providing some grip-enhancing support along the forefinger's proximal phalanx, where the forefinger segment often touches the golf club during a golf swing.

Among the benefits of the present invention include: the ability to offer greater golf consistency and accuracy by solving this previously unsolvable problem in prior art; a far more successfully coordinated golf swing; and heightened feel capabilities for better feedback if the golf club inappropriately moves during a golf swing. Using this embodiment will allow a user to maximize feel with both hands.

This embodiment may also comprise of a wrist securement opening means to secure the glove to the user's hand. The opening means may be, for example, an elastic means or a flap which mechanically engages a flap capture mechanism (e.g., a synthetic hook and loop fastening interface which adheres when pressed together, commonly using VELCRO). The wrist portion opening means may alternatively comprise an elastomeric band fixed around then wrist aperture. Embodiments may also have combinations of both a flap capture mechanism and an elastomeric band. The wrist portion may be formed integral with the glove or may be attached to the glove by standard methods, such as by sewing.

This and other embodiments may be in the form of a standard synthetic leather golf glove, with the dorsal and palmar surface areas essentially covering all five metacarpals, with the exception of a slit along the dorsal surface which allows the golfer to insert the hand into the glove, and micro recesses along portions of the glove to allow for ventilation.

The increased grip capabilities will provide a user with more stable grip capabilities to coordinate a golf swing, and help minimize is even a modest amount of unnecessary movement between both hands, and to more properly adjust his or her next golf swing. Embodiments of the present invention offer these significant improvements thereby solving an unrecognized problem in prior art.

These embodiments will be useful and significantly beneficial to those playing the sport of golf, primarily because the unique finger configurations of the glove, as well as because of any grip enhancing means on embodiments.

The benefits of these significant and substantially different physical configurations of the present invention will inevitably create a new method of gripping a golf club. The generally accepted method of swinging a golf club is clearly a result of the limitations of prior art gloves.

The present invention will, for example, allow a user's weak hand to have heightened tactile sensitivities as well as increased grip capabilities, to have a better coordinated and proper golf swing. Once a user begins to swing the golf club, the user can have heightened sensitivities to feel if the hands suddenly are misaligned, for example. The golfer should now have a more stable overall grip, better control and enhanced performance possibilities. This improved method, of gripping and swinging a golf club using the interlocking grip method, will provide a user with greater overall control and consistency in a golf swing.

SUMMARY

Many features can be used in conjunction with each other to uniquely solve problems that have up until now been unsolved, and perhaps also unrecognized.

In general, embodiments of the present invention can generally be used in conjunction with any type of hand task activity and/or sports play. As discussed, embodiments offer an individual with the opportunity to increase overall hand task performance. Maintaining or increasing overall control, for example, can provide many benefits to a user of these, and other embodiments. These and other embodiments:

offer the ability to grip as well as feel a sports device, such as a golf club provide a unique solution for users who desire better grip capabilities only in select areas offer a more stabilizing overall grip of a ball or object, by conveying grip-enhancers to select locations of the back of the hand portions of a glove provide grip enhancers along the connecting area between the middle finger and forefinger segments permit the ability to use a glove on a weak hand configured to meet the unique needs of a user's preferred golf grip, especially for those using an interlocking grip improve performance in hand task execution by providing heightened feel capabilities on a golfer's weak hand offer more control capabilities for the interlocked pinkie finger, a valuable feature when striking a golf club with greater velocity allow more hand coordination by adjusting grip-enhancers to match a preferred variation of the interlocking golf grip method decrease the likelihood of golf slices because of less chance of hand separation during a golf swing provide superior coordination in a golf swing enhance overall control and golf swing stability increase the possibility for squarer golf clubface at impact with the golf ball thereby improving ball contact, trajectory and accuracy provide a much improved method of playing the sport of Golf by using grip enhancers not just on the weak hand but also for the strong hand's pinkie finger as well, without limiting the feel and coordination requirements in a proper golf swing create a more strategically placed moisture management system that is more appropriately suited for golfers who use the interlocking grip method provide added grip for golfers with relatively smaller hands provide added grip for golfers with relatively weaker hands provide added control for golfers who desire a more unified hand grip of the golf club provide a solution for golfers who find their hands becoming separated during a golf swing These are among the many benefits of the present invention, and are not to be construed as limitations of the benefits nor their legal equivalent.

Although the description of the present invention only discussed two sports, it is understood that individuals playing other sports might benefit as well, such as football.

Furthermore, only some embodiments have been discussed and in no way is intended to limit all the various embodiments and other embodiments that the present invention provides, such as but not limited to, different designs or multicolors or fluorescent colors. Embodiments can of course be used by men and women, boys and girls, professional athletes or amateurs, as well as by those whose dominant hand is the right hand or the left.

BRIEF DESCRIPTIONS OF THE DRAWING

It is expressly understood that the following descriptions and drawings are for illustration purposes only, and in no way are intended to limit the scope of the present invention and its various embodiments. For example, the drawings are of embodiments for the left hand but can easily be created for the right hand.

FIG. 1 is a drawing of the palmar (front) view of an embodiment. The glove completely covers the thumb, middle finger, ring finger and pinkie finger. The glove also has a finger segment that covers the forefinger's proximal phalanx but does not extend to cover the forefinger's middle or distal phalanges.

DETAILED DESCRIPTION OF THE DRAWINGS

It is expressly understood that the drawings are for the purpose of illustration and description only and are not intended as a definition of the limits of the invention.

Figure 1:
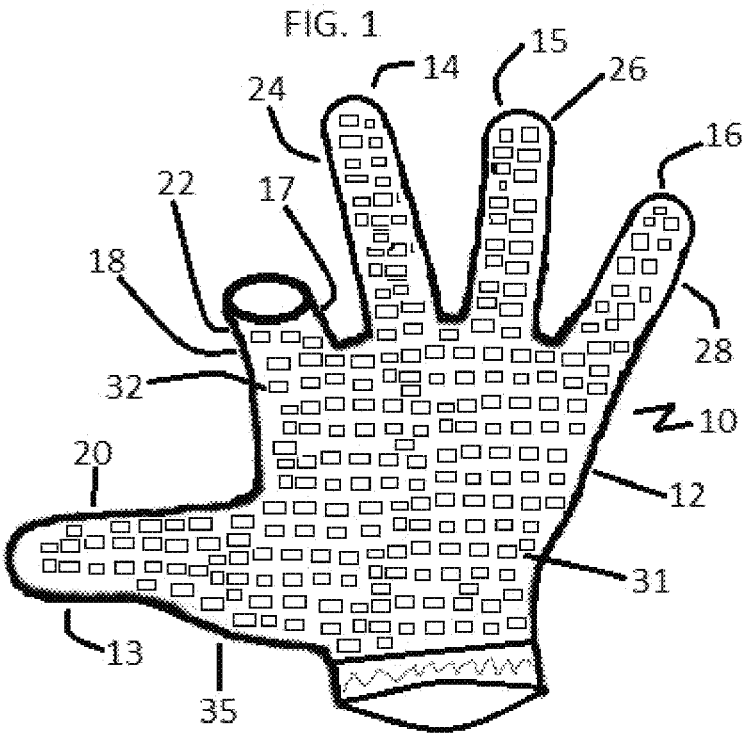
Figure 2:
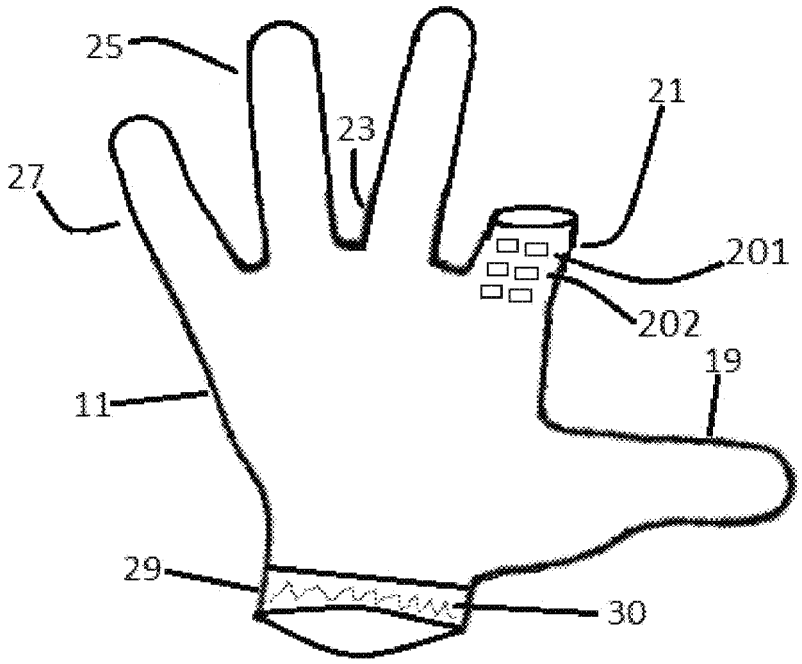
FIG. 2 is a drawing of the embodiment as described in FIG. 1, showing the dorsal (back) view.

Referring now to FIG. 1 and FIG. 2, an embodiment of the present invention is shown and designated as 10. The palmar view of a left-handed glove is drawn in FIG. 1 and the dorsal view of the same glove is drawn in FIG. 2. This partial-fingered embodiment provides a glove having a dorsal portion 11, a palmar portion 12 for overlaying respective back and palm regions of a human hand, said dorsal and palmar portions having distal and proximal ends with a plurality of digital segments (or stalls) projecting from said distal ends. The glove includes a glove body having a back portion covering the back of the hand 11, and a front portion covering the palm or front of the hand 12. The glove body includes finger stalls (or digital segments) and a thumb stall (digital segment) each adapted to receive a finger or thumb, respectively, therein.

In the illustrated embodiment the glove is constructed such that the thumb 13 digital segment encloses said thumb, including enclosing the fingertips. The glove has a middle finger digital segment 14 that encloses the middle finger, including the fingertips, a ring finger digital segment 15 that encloses the ring finger, including the fingertips, and a pinkie finger digital segment 16 that covers the pinkie finger, including the fingertips of a user. In addition, the glove has a forefinger digital segment 17 that covers only the proximal phalanx 18, in its entirety, but does not extend to cover any portion of a user's middle or distal phalanges of the forefinger, therefore defining the forefinger segment's terminal edges.

The palmar section also covers the palm segment overlaying the palm of the hand 12; the dorsal section also covers the back of the hand 11. The glove also has a wrist portion that surrounds the wrist of a user.

The thumb stall 13 is defined by a dorsal portion 19 and a palmar portion 20. The forefinger stall 17 is defined by a dorsal portion 21 and a palmar portion 22. The middle finger stall 14 is defined by a dorsal portion 23 and a palmar portion 24. The ring finger stall 15 is defined by a dorsal portion 25 and a palmar portion 26. The pinkie finger stall 16 is defined by a dorsal portion 27 and a palmar portion 28.

The wrist portion is preferably expansible so as to hold more securely to the user's wrist. Therefore the embodiment also has an expandable opening means 29 at a wrist end 30 adapted to receive the user's hand. The expandable opening means comprises an elastic material along the wrist portion, such as an elastomeric band 29 fixed around the wrist. If desired, the opening means may comprise a strap means at the open end of the glove body for fastening the glove body secure about the wrist area, or a combination thereof. The strap may have two pads of cohesive-adhesive material for releasably securing the strap. The strap as well as this wrist portion may be sewn onto the glove, for example.

This embodiment further shows how the present invention may comprise a grip enhancing means on the palmar or the dorsal segments, and provide a higher coefficient of friction than the surrounding areas of the grip enhancing means.

In the illustrated embodiment, the grip enhancing means comprises high friction surfaces 31 and 201, formed on the entire palmar surface of the glove 12, including the palmar surfaces of the thumb segment 20 and any existing finger segments 22, 24, 26 and 28, as well as only on the proximal phalanx of the forefinger's dorsal segment 201. Preferably, the high friction surface is formed from a PVC material, a nitrile material, a latex material, or a rubber material (as shown) 35. The surface may include a depression or projection pattern formed from the high friction material. Formed on the illustrated material is a plurality of square-like projections 32 and 202 that are applied to the entire palmar surface area and select area of the dorsal surface by any standard means, as aforementioned, defining the respective boundaries. These square-like projections preferably are spaced apart to allow for added grip and flexibility. The rubber—or other materials aforementioned—palmar surface can then be conjoined to the dorsal surface, thus creating the glove. Preferably, the heights of the embodiment's projections are such that the gap formed by the projections allow for some movement of the affected surfaces thereby increasing the grip capabilities of the user. The height can generally begin at about one hundred micrometers to several millimeters or more. For example, these projections are about two hundred micrometers in height, about two millimeters in width and four millimeters in length.

The dorsal surface is preferably of similar material as the palmar segment. It may, of course comprise of a different material than the palmar surface, such as a more durable fabric, but would preferably also be rather flexible. If the dorsal surface is comprised of more durable fabrics, such as synthetic leather, then some added elasticity capabilities may be also preferable, though not required, on select area of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint. Alternatively, embodiments may simply comprise of a more elastic material, such as any of those aforementioned such as spandex, on the dorsal surface overlaying said metacarpophalangeal joints, or seams or slits, while the rest of the dorsal surface is comprised of a more durable material. The elastic material could be stitched onto those areas, and therefore replacing the more durable materials along those select areas.

The palmar and dorsal surfaces, and any wrist portions, may then be conjoined on any finger and thumb portions, dorsal and palm portions and a wrist portion using any standard methods, such as by stitching, thus defining a pocket for receiving a user's hand.

As aforementioned, this embodiment provides users with several benefits, in multiple sports. For example, those playing the sport of Golf may use this embodiment on their weak hand thereby allowing the golfer significantly more grip capabilities while simultaneously being able to have heightened tactile abilities at the same time on key areas of the interlocked—and partially uncovered—forefinger.

Figure 3:
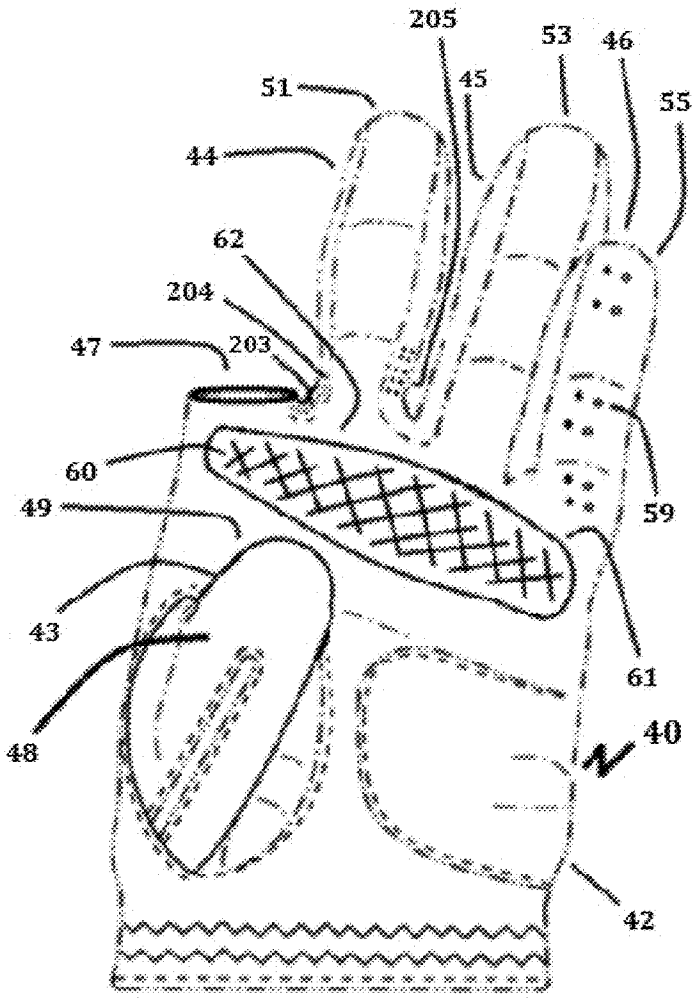
FIG. 3 is a drawing of the palmar view of a second embodiment.
Figure 4:
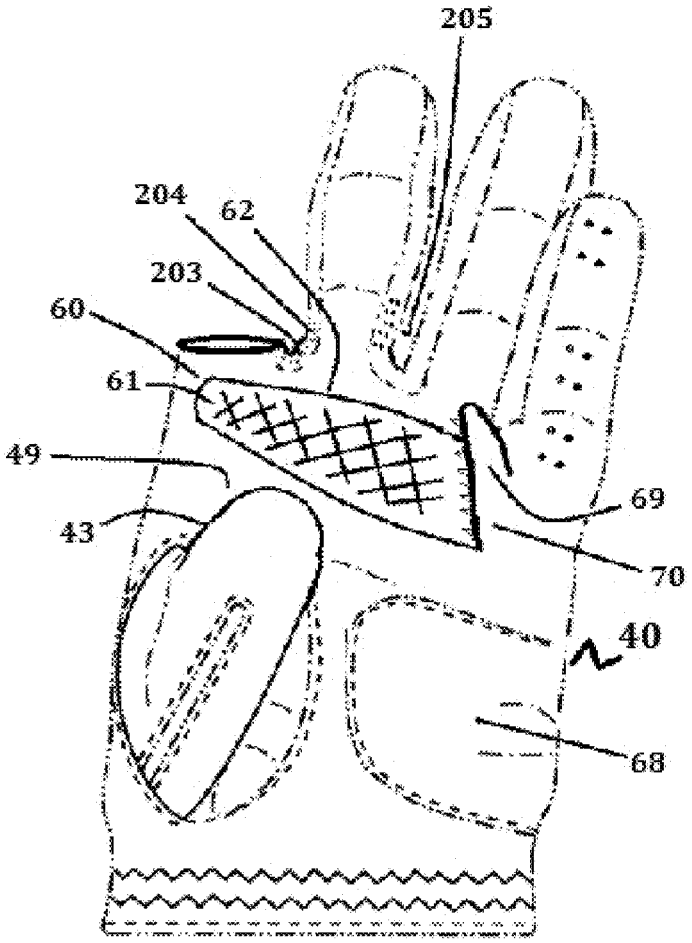
FIG. 4 shows the top and bottom view of a panel which creates a higher friction surface on an embodiment, as shown in FIG. 3.
Figure 5:
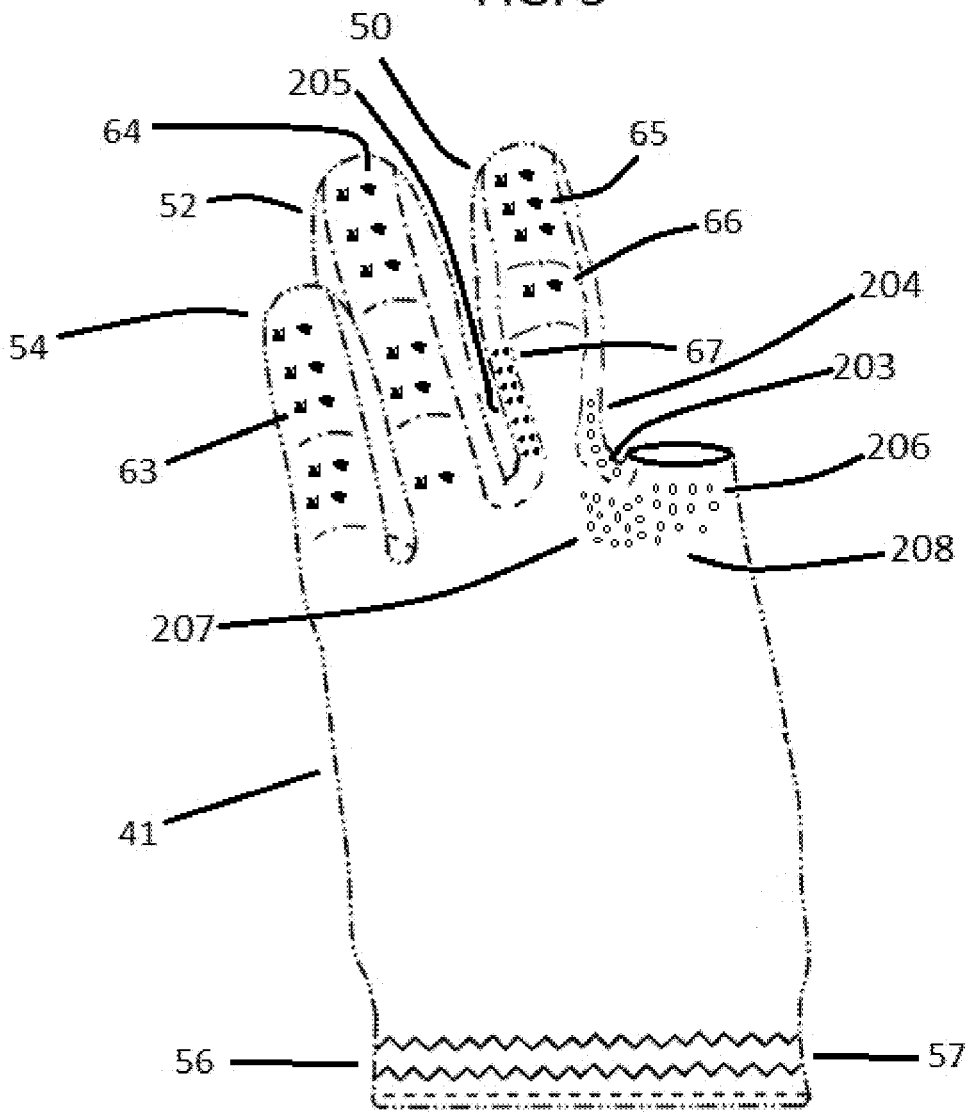
FIG. 5 is a drawing of the embodiment as described in FIG. 3, showing the dorsal view.

Referring now to FIG. 3, FIG. 4 and FIG. 5, a second embodiment of the athletic glove of the present invention is shown and designated as 40. The palmar (front) view of a left-handed glove is drawn in FIG. 3 and the dorsal (back) view of the same glove is drawn in FIG. 5. This partial-fingered embodiment provides a glove having a dorsal portion 41 and a palmar portion 42 for overlaying respective back and palm regions of a human hand, said dorsal and palmar portions having distal and proximal ends with a plurality of digital segments (or stalls) projecting from said distal ends. The glove includes a glove body having a back portion covering the dorsal surface of the hand 41, and a front portion covering essentially the entire palm surface of the hand 42. The glove body includes finger segments and a thumb segment each adapted to receive a finger or thumb, respectively, therein.

In the illustrated embodiment, the glove is constructed such that the thumb 43 digital segment encloses said thumb, including enclosing the fingertips. The glove also has a middle finger digital segment 44 that covers the middle finger, including the fingertips, a ring finger digital segment 45 that covers the ring finger, including the fingertips, and a pinkie finger digital segment 46 that covers the pinkie finger, including the fingertips of a user. This embodiment does not have a forefinger digital segment 47 therefore a user's forefinger is completely uncovered.

The palmar surface of this glove embodiment therefore essentially covers the rest of the front of the hand, including the entire palm of the hand 42; the dorsal section covers most of the rest of the back of the hand 41, allowing for possible micro-recesses for ventilation.

The thumb stall 43 is defined by a dorsal portion 48 and palmar portion 49. The middle finger stall 44 is defined by a dorsal portion 50 and a palmar portion 51. The ring finger stall 45 is defined by a dorsal portion 52 and a palmar portion 53. The pinkie finger stall 46 is defined by a dorsal portion 54 and a palmar portion 55. There is no forefinger stall so there is no dorsal or palmar portion defining the forefinger stall.

The glove also has an expandable opening means at a wrist end portion 56 adapted to receive the user's hand. The expandable opening means comprises an expandable opening means comprised of an elastic material such as an elastomeric band 57 fixed around the wrist to expand and contract for easier glove application onto a hand. The wrist portion is preferably expansible so as to hold more securely around the user's wrist. As with other embodiments, the glove may alternatively, or additionally, have a strap means at the open end of the glove body for fastening the glove body secure about the wrist area. The strap means may be unitary with the glove body and may include VELCRO fasteners, buttons, and the like or other suitable closure means thereon.

This embodiment further shows how the present invention may comprise a grip enhancing means on select segments of the glove, and provide a higher coefficient of friction than the surrounding areas of the grip enhancing means, the dorsal portion of the ring finger digital segment, pinkie finger digital segment and thumb digital segment designed to overlay a distal phalanx of the wearer's middle finger, ring finger and thumb are completely free of said grip enhancing means when the glove is worn.

The pinkie finger palmar digital segment 46, the region between the middle finger and a user's forefinger 203, the side of the middle finger proximal phalanx segment 204, and portions of the dorsal segment on, around and between the glove overlaying the forefinger and middle fingers metacarpophalangeal joints of this embodiment all have a grip enhancing means 206 and 207, in the form of PVC dots 59, 203, 204, 206, 207. The PVC dots preferably project out at least about seven hundred micrometers. The PVC dots located on the palmar section of the pinkie finger stall are throughout said stall. Similar embodiments may have a grip enhancing means also along the thumb segment, or combinations thereof, to maximize grip abilities on the fingertips of the thumb and pinkie finger. This will allow for greater golf club grip retention especially throughout the down swing of a golf swing when some separation between the hands takes place. Providing the grip enhancing means on the dorsal portion and select side portions allow the ungloved pinkie finger to interlock and better grip the gloved weak hand, a major and necessary improvement.

The grip enhancing means of the present invention may be integral to the glove or may be affixed to the glove using any standard methods. For example, this embodiment comprises grip enhancing means that is integral to the glove, using any standard method known in the art. For example, the PVC dots can be imparted by any standard methods, such as, for example, by molding. The heights of the PVC dots in this embodiment are all the same height, and are generally in rows. Other embodiments could of course offer different heights, non-uniform heights, and have a more random pattern on the top surface.

The locations of the grip enhancing means may vary on several factors of course, such as personal preference and preferred degree of enhanced grip. This added grip configuration will be useful especially to golfers who use the interlocking grip method for purposes of unifying both hands throughout the golf swing, and for other reasons described herein, wherein the ring finger digital segment dorsal portion, the pinkie finger digital segment dorsal portion and the thumb digital segment dorsal portion are completely free of said grip enhancing means.

For example, a grip enhancing means is provided on select areas of the dorsal surface of the embodiment. Specifically, the grip enhancing means is provided on and around the forefinger's metacarpophalangeal joint 206 but does not extend beyond the forefinger's metacarpophalangeal joint 208. Additionally, a grip enhancing means is provided between the forefinger's metacarpophalgeal joint and the middle finger's metacarpophalgeal joints 207, defining its terminal edges, but can also be configured to provide a grip enhancing means on a portion of the middle finger's metacarpophalangeal joint, but generally not more than about fifty-percent.

The embodiment's grip enhancing means can also comprise of a high friction surface, such as creating crisscross projections 60 for example, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint. The grip enhancing means portion overlaying the pinkie finger metacarpophalangeal joint may preferably not extend over the upper-palmar crease, however, to provide optimal flexibility, although some embodiments may extend to cover the entire pinkie joint.

The grip enhancing means can also comprise of a high friction surface by applying a non-slip coating, such as a latex, a nitrile or PVC coating, along described locations of this embodiment. The coating could of course also be applied to the entire palmar portion of the glove.

This grip enhancing means may also be affixed to the glove. In general, as aforementioned, a grip enhancing means may be either formed, affixed, or inserted, on any palmar portion, such as the palm or any thumb or any existing finger stalls, on the dorsal portion of the forefinger or middle finger segments ranging from the distal phalanges through their metacarpophalangeal joints, or on the sides of the thumb, forefinger or middle finger segments, ranging from the distal phalanges to through their metacarpophalangeal joints, using any standard methods. The embodiment's gripping means can comprise of a high friction surface, such as creating crisscross grooves 60 that are depressions onto a rubber surface panel 61, for example, then attaching said panel onto a portion of any of the above selected surface areas. The panel is attached to the palmar surface of the glove by any standard methods of attachment, such as by adhesion or stitching.

The panel may be is attached to the glove area, for example, beginning at the digital creases and extending to overlay the forefinger metacarpophalangeal joint, the middle finger metacarpophalangeal joint, the ring finger metacarpophalangeal joint, and the pinkie finger metacarpophalangeal joint, 62. The panel portion overlaying the pinkie finger metacarpophalangeal preferably does not extend over the upper-palmar crease, however, to provide optimal flexibility.

The panel may generally be comprised of any flexible material, for example, a plastic material having a top surface comprising the grip enhancing area formed by a plurality of depressions, such as, for example, ridges.

A preferred depth of the crisscross depressions would be such that the gap formed by the depressions would allow for some movement of the newly formed top surface edges thereby increasing the grip capabilities of the user. This grip enhancing means could have a preferred depth beginning about six hundred micrometers, and can be imparted by, for example, embossing or standard mechanical treatments.

Alternatively, this grip-enhancing means may be attached, affixed or otherwise placed to select areas 62 of the glove by standard methods and forms of attachment such as by creating a textured surface on a silicone-based layer and then hot melting said silicone surface onto the palmar portion of the glove for example, thus providing a high friction surface on the embodiment. The panel could also be bonded to, and become a portion of the glove as claimed, by any other standard method.

It will be apparent to one of ordinary skill in the art that many other implementations of creating and applying panels to sports gloves are possible.

The grip enhancing surface would provide an effective coefficient of friction than on the surrounding areas.

The locations of the grip enhancing means may vary on several factors of course, such as personal preference and preferred degree of enhanced grip. Additionally, the depressed designs may vary, such as being in the form of non-linear or crisscross lines, for example. Finally, the depths may vary as well.

Figure 10:
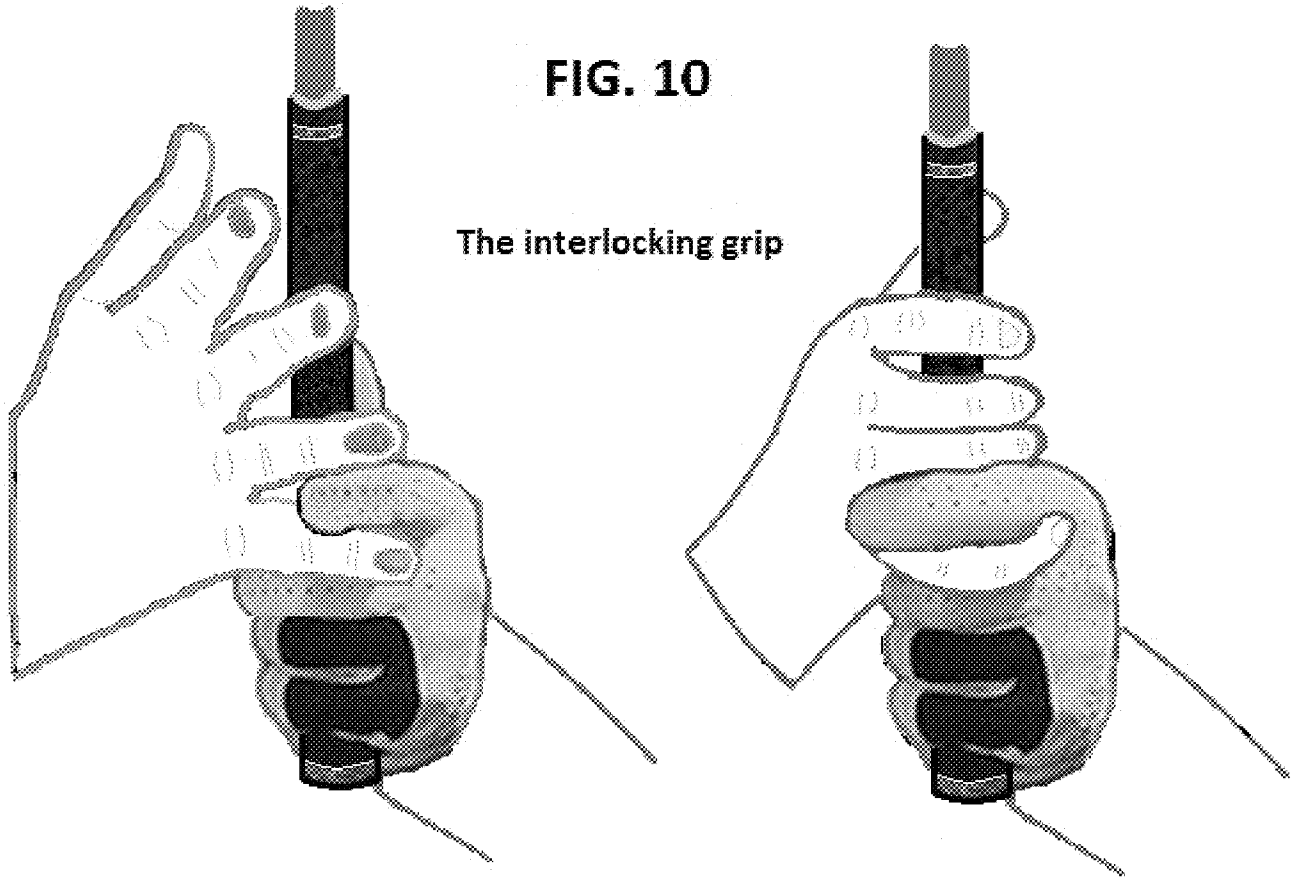
FIG. 10 shows a typical interlocking grip using a conventional prior art glove.

A plurality of micro recesses of about 0.120 millimeters in diameter may be randomly disposed about the front, back and finger and thumb stalls of the glove, thereby providing added comfort and more ventilation. The illustrated embodiment has micro recesses along and throughout the pinkie finger segment 63 and ring finger segment 64. Additionally, there are micro recesses along only the distal 65 and middle phalanges 66 of the middle finger segment. As important aspect of this embodiment is that there are micro recesses only along the side of the proximal phalanx 67 of the middle finger 205. When a user of this embodiment grips a golf club using the interlocking grip, the strong hand's pinkie finger interlocks with the completely uncovered forefinger thereby providing heightened tactile sensitivities throughout the interlocked fingers. However, as can be seen in FIG. 10, the strong hand's pinkie finger also comes into contact with the weak hand's middle finger segment—specifically with the middle finger's proximal phalanx. Providing micro-recesses along the middle finger's proximal phalanx should direct moisture away from the interlocked fingers. Therefore, this embodiment also solves an unrecognized configuration problem with prior art.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example.

This embodiment further shows how the present invention may comprise of essentially the same materials to construct both the palmar and dorsal surface. This particular glove can be made of a polyester and cotton blend for superior comfort, say about seventy percent polyester. The polyester thread, for example, could be spun with the cotton yarns to produce the composite. Other materials that could comprise these glove embodiments include, but are not limited to woven materials that include natural, synthetic or blends of natural and synthetic yarns, flexible plastics, and thermoextruded or thermoset rubbery embodiments including those made from thermoplastic elastomers. Examples of synthetic yarns include nylon, polyester, and spandex (polyurethane) yarns, and LYCRA. Alternatively, the embodiment may simply comprise of standard synthetic leather and lycra.

Additionally, embodiments such as this one, may be completely coated with a with a water repellant substance, such as a synthetic resin 68 on the palmar surface or throughout the entire glove.

This unique offering will significantly increase a user's ability to control a golf club and also therefore a golf swing and golf ball.

Referring now specifically to FIG. 4, what is shown is the top (front) and bottom (back) portions of a panel which creates a higher friction surface on an embodiment, as shown in FIG. 3. Specifically, shown is a panel overlaying much of the metacarpophalangeal joints of the forefinger, middle finger, ring finger, and pinkie finger stalls 62.

In general, as aforementioned, a grip enhancing means may be either formed on or applied to any selected portions of the glove, such as the palm or any thumb or any existing finger stalls, using any standard methods.

This embodiment shows a gripping means comprising of a high friction surface, such as creating crisscross grooves 60 that are projections onto a rubber surface panel 61, for example, then attaching said panel onto a portion of the gloves palmar surface area. The bottom portion of the panel 69 is attached to the palmar surface of the glove by any standard methods of attachment, such as by an adhesive 70 or stitching. In addition, a grip enhancing means is provided on the region between the middle finger segment and a user's forefinger 203. A grip enhancing means is also provided on a portion of the middle finger's proximal phalanx segment, specifically along the side adjacent a user's forefinger, not extending to cover more than approximately twenty-five percent of the middle finger's proximal phalanx.

Figure 6:
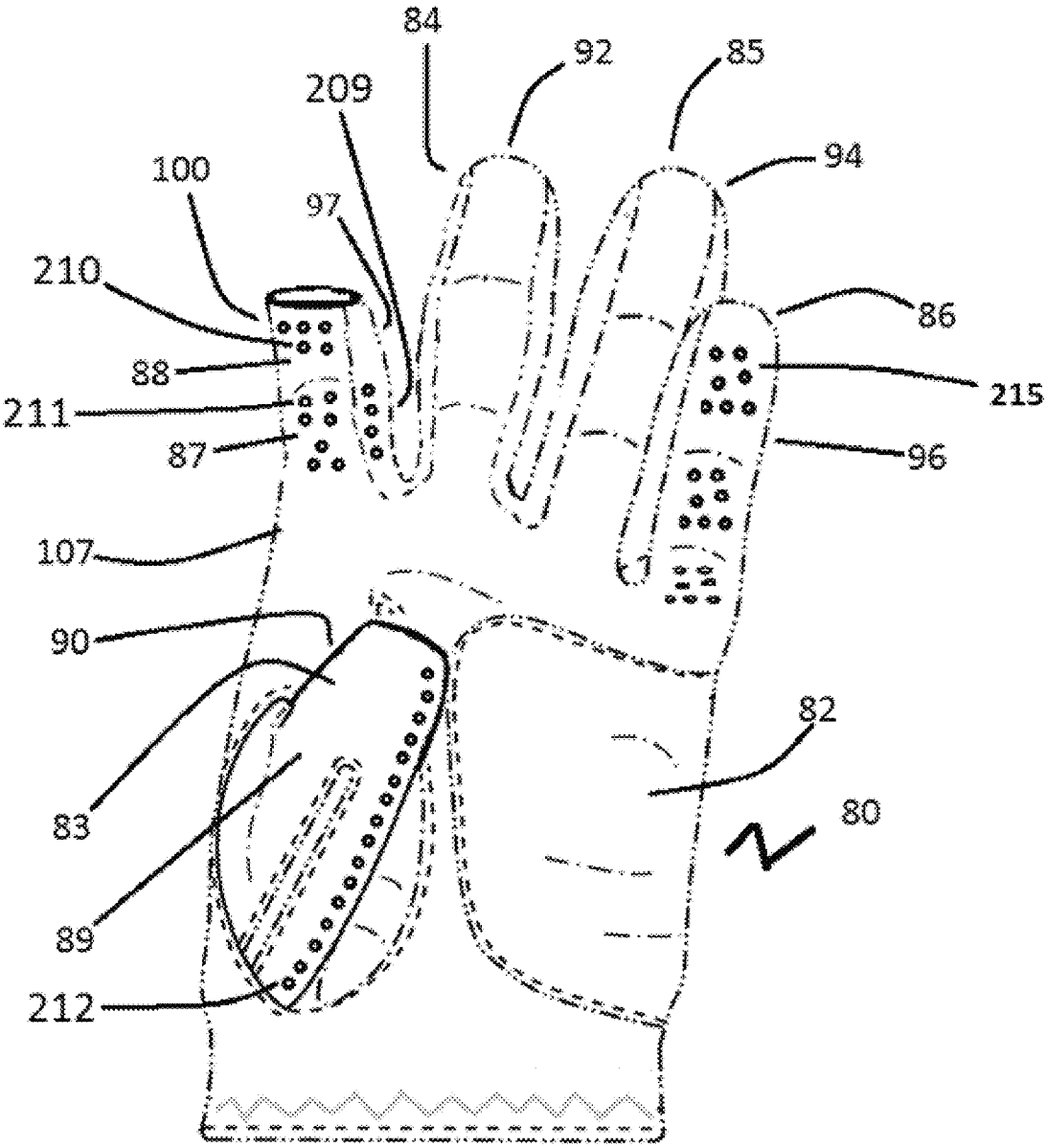
FIG. 6 is a drawing of the palmar view of a third embodiment, shown as a partial-fingered glove. The glove has a forefinger segment that covers the forefinger's proximal and middle phalanges but does not extend to cover the forefinger's distal phalanx.
Figure 7:
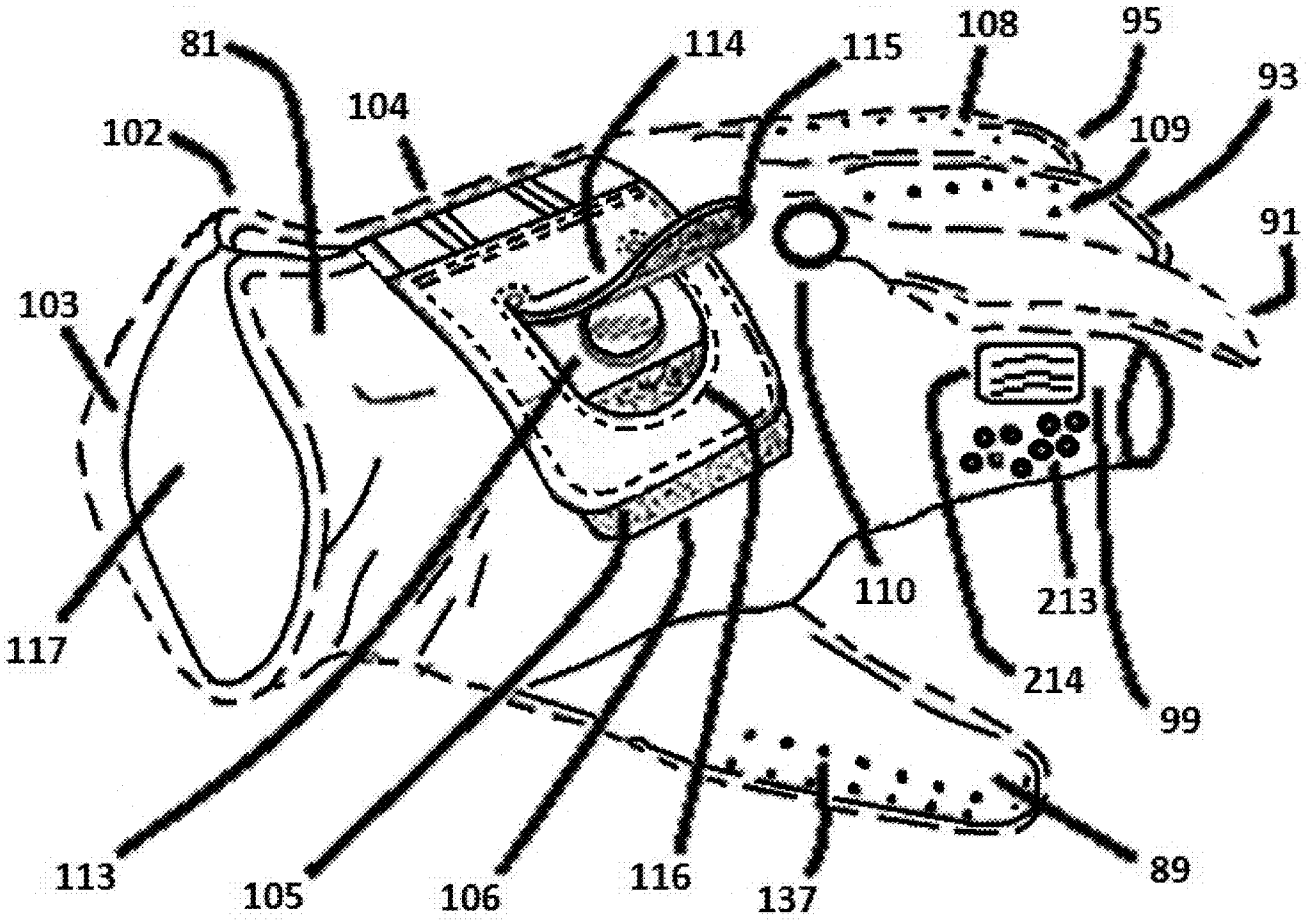
FIG. 7 is a drawing of the embodiment as described in FIG. 6, dorsal view.

Referring now to FIG. 6 and FIG. 7, an athletic glove of the present invention is shown and designated as 80. The palmar (front) view of a left-handed glove is drawn in FIG. 6 and the dorsal (back) view of the same glove is drawn in FIG. 7. This partial-fingered embodiment provides a glove having a dorsal portion 81, a palmar portion 82 for overlaying respective back and palm regions of a human hand, said dorsal and palmar portions having distal and proximal ends with a plurality of digital segments (or stalls) projecting from said distal ends. The glove includes a glove body having a back portion covering the back of the hand 81, and a front portion covering the palm or front of the hand 82. The glove body includes finger stalls and a thumb stall each adapted to receive a finger or thumb, respectively, therein.

In the illustrated embodiment, the glove is constructed such that the thumb segment 83, middle finger segment 84, ring finger segment 85 and pinkie digital segment 86 enclose said thumb, middle finger, ring finger, and pinkie fingers including enclosing the fingertips, respectively. The glove also has a forefinger segment that covers the forefinger's proximal 87 and middle phalanges 88 but does not extend to cover the entire forefinger's distal phalanx; a user's forefinger's fingertips are therefore exposed.

The palmar section covers the entire palm of the hand 82 and the dorsal section covers the back of the hand 81. The glove also has a wrist portion that surrounds the wrist of a user.

The thumb stall 83 is defined by a dorsal portion 89 and a palmar portion 90. The middle finger stall 84 is defined by a dorsal portion 91 and a palmar portion 92. The ring finger stall 85 is defined by a dorsal portion 93 and a palmar portion 94. The pinkie finger stall 86 is defined by a dorsal portion 95 and a palmar portion 96. The forefinger stall 97 is defined by a dorsal portion 99 and a palmar portion 100.

The wrist portion is preferably expansible so as to hold more securely to the user's wrist. Therefore the embodiment also has an expandable opening means at a wrist end 102 adapted to receive the user's hand. The expandable opening means comprises an elastic material along the wrist portion, such as an elastomeric band 103 fixed around throughout the wrist. In addition, the opening means comprises a strap means 104 at the open end of the glove body for fastening the glove body secure about the wrist area. The strap means may be unitary with the glove body and may include VELCRO fasteners 105, 106, buttons, and the like or other suitable closure means thereon.

This embodiment further shows how the present invention may comprise a grip enhancing means on select segments of the glove, and provide a higher coefficient of friction than the surrounding areas of the grip enhancing means.

The grip enhancing means can comprise of a high friction surface by applying a non-slip coating, such as a latex, a nitrile 107 or PVC coating, along described locations of this embodiment, such as on the forefinger's metacarpophalangeal joint segment. Those using the interlocking grip would find this grip enhanced location especially useful when trying to maintain golf club control along the forefinger's metacarpophalangeal joint, the area just below where the weak hand's forefinger interlocks with the dominant hand's pinkie finger.

The coatings could of course also be applied to any selected portions of the glove.

The grip enhancing surface would provide an effective coefficient of friction, preferably of at least a Shore A Durometer of two or greater.

The locations of the grip enhancing means may vary on several factors of course, such as personal preference and preferred degree of enhanced grip. This added grip configuration will be useful especially to those playing the sport of Golf for reasons described herein. Other grip enhancing configurations and locations may of course be preferred.

In the illustrated embodiment, a grip enhancing means also comprises high friction surfaces 81 and 82, formed on the glove 80, including the palmar surface of the pinkie segment 96, on the palmar surface of the forefinger segment 100, on the side surface of the forefinger's proximal phalanx 209 adjacent the middle finger segment, on the side surface of the forefinger's proximal and middle phalanges 213 adjacent the thumb segment, on the dorsal surface of the forefinger segment 99, and on the side surface of thumb segment 212, defining their respective boundaries.

These surface areas may include a depression or projection pattern formed from the high friction material, or any other form or structure aforementioned in this specification of course. Formed on the illustrated material is a plurality of oval-like depression 209, 210, 211, 212, 213 and 215, that are applied to select areas of the embodiment by any standard means, as aforementioned, defining the respective boundaries. These oval-like depressions preferably are spaced apart to allow for added grip and flexibility.

In the illustrated embodiment, a grip enhancing means is also located on the dorsal segment of the forefinger's proximal phalanx 99. Specifically, this finger portion has an insert 214. The insert is positioned midway along the dorsal segment of its proximal phalanx and does not extend beyond the proximal phalanx, thereby defining the boundaries of the insert (it can include the forefinger's metacarpophalangeal joint, although this embodiment does not).

The insert is preferably of a synthetic material having grip-enhancing characteristic properties as to provide the embodiment with a higher coefficient of friction than the replaced glove material.

The insert is secured by any standard methods, such as, for example, by replacing the selective glove material in the area defined by sewing (as shown on the edges of the rectangular insert) or similar affixing techniques common to glove construction.

Formed on the insert are non-linear lines, or depressions, creating the grip enhancing characteristics of the embodiment's insert.

Preferably, the depths of the embodiment's grip enhancing means are such that the gap formed by the depressions allow for some movement of the affected surfaces thereby increasing the grip capabilities of the user. The depth can generally begin at about one hundred micrometers to several millimeters or more. For example, these depressions are about two hundred micrometers in depth, about two millimeters in width and four millimeters in length.

Having a gripping enhancing means along these areas will significantly increase a user's ability to control an object such as a golf club by creating an even higher coefficient of friction.

The embodiment's grip enhancing means can also comprise of other high friction configurations of course, such as creating crisscross projections, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint. The height of the projections may vary, as aforementioned. These projections can start at about ½ millimeter in height, for example.

A plurality of micro recesses of about 0.120 millimeters in diameter may be randomly disposed about the front, back and finger and thumb stalls of the glove, thereby providing added comfort and more ventilation. The illustrated embodiment provides micro-recesses throughout the thumb 137 as well as the pinkie finger 108 and ring finger digital segments 109. Additionally, no micro-recesses are provided on the embodiment's middle finger segment but may be provided along said segment's middle or distal phalanx segment, if preferred. An aperture is provided along the middle finger metacarpophalangeal joint segment 110 to allow moisture to escape the middle finger segment without disturbing the interlocked finger area.

The embodiment is suitably a substantially conventionally constructed golf glove, modified as aforementioned. This particular glove can be made of a synthetic leather latex coated glove for added durability. Other materials that could comprise these glove embodiments include, but are not limited to woven materials that include natural, synthetic or blends of natural and synthetic yarns, thermoextruded or thermoset rubbery embodiments including those made from thermoplastic elastomers, cloths or cabretta leather. Examples of synthetic yarns include nylon, polyester, and spandex (polyurethane) yarns. Additionally, embodiments such as this one, may be coated with a with a water repellant substance, such as a synthetic resin throughout the entire outer surface of the glove.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction.

This embodiment may also comprise a detachable ball marker 113. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object with a design that points to where the golf ball exactly is located.

The detachable ball marker is secured by any standard fastening means, such as by a compartment, by magnetism or snap fastening, for example. The illustrated embodiment shows a compartment 114 within the strap on the dorsal segment of the glove. The compartment secures the ball marker by VELCRO fasteners 115, 116, but other commonly known fasteners will work just as well. The ball marker may be circular or non-circular in design.

Additionally, embodiments may offer a liner is fixed to the interior of the glove using methods known in the art, such as stitching. The liner 117 may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in harsher conditions or during extended practices on the golf range, for example.

It will be apparent to one of ordinary skill in the art that many other implementations of liners are possible.

Figure 8:
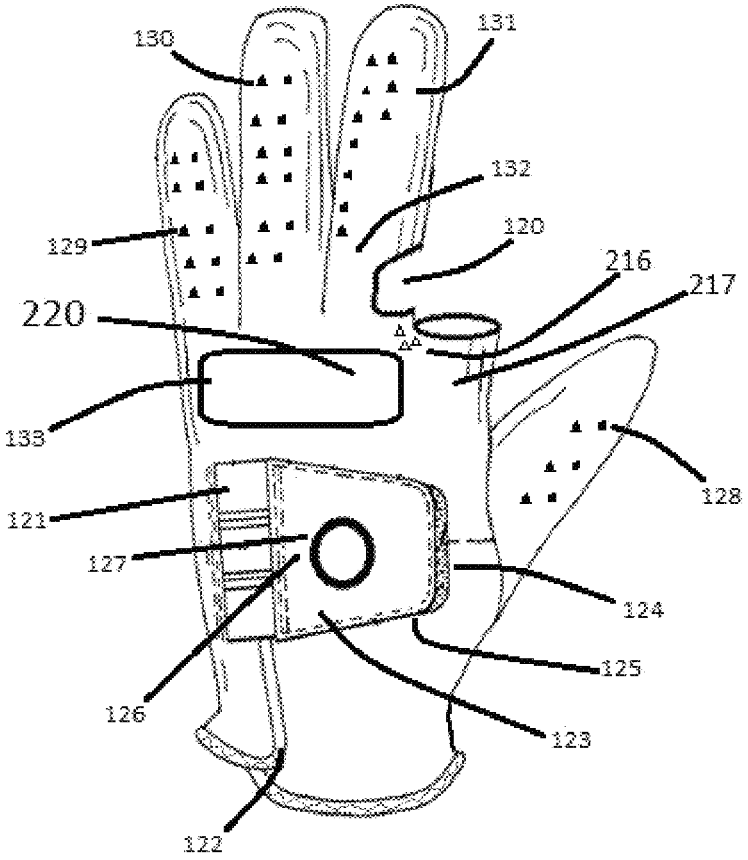
FIG. 8 is an alternative dorsal segment to FIG. 3.

FIG. 8 shows an alternative dorsal segment to FIG. 3. Embodiments may also preferably comprise an aperture 120 along the middle finger segment, such as on any or all of middle finger's proximal phalanx. This embodiment shows an aperture that resides only on the middle finger's proximal phalanx, large enough such that the skin of the middle finger may touch or be touched by the pinkie finger of the dominant hand, for example, while gripping a golf club. As shown, the aperture resides primarily on the dorsal portion extending to the side of said middle finger segment.

In addition, the embodiment also has an expandable opening means 121 at a wrist end 122 adapted to receive the user's hand. The expandable opening means comprises a strap means 123 at the open end of the glove body for fastening the glove body secure about the wrist area. The strap means may be unitary with the glove body and may include VELCRO fasteners 124, 125, buttons, and the like or other suitable closure means thereon. The strap may have two pads of cohesive-adhesive material for releasably securing the strap, for example. The strap as well as the wrist portion may be sewn onto the glove.

This embodiment also comprises a detachable ball marker 126. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object 126. The detachable ball marker is secured by any standard fastening means, such as by snap fastening 127, by a VELCRO fastening compartment, or by magnetism.

The embodiment also provides micro recesses along the portion of the thumb stall 128, the ring finger segment 130 and pinkie finger segment 129, for ventilation, as is standard. However, while offering micro-recesses along the dorsal portions of middle and distal phalanges of the middle finger segment 131 these micro recesses are positioned in a way to direct moisture away from the interlocked fingers; there are no micro recesses along any remaining proximal phalanx segment of the middle finger 132.

The materials forming the illustrated embodiment may comprise those discussed in reference to the present invention. Likewise, any previously discussed methods of construction may be applied to this embodiment. This dorsal segment may be constructed as many standard golf gloves, made primarily of a durable but flexible material, such as synthetic leather, while providing a much more elastic fiber such as spandex 133, along the metacarpophalangeal joints of the four fingers. More broadly the material 133 could also comprise a mesh knit polyester fabric insert across this area. Weft rib knit fabrics are porous so benefit of greater movement and they assist in eliminating moisture.

This embodiment further shows how the present invention may comprise a grip enhancing means on the palmar or the dorsal segments, and provide a higher coefficient of friction than the surrounding areas of the grip enhancing means.

In the illustrated embodiment, a grip enhancing means also comprises high friction surface formed on the glove, including the dorsal surface area of the region between the forefinger segment and the middle finger segment 216, formed by a plurality of triangle-like projections. This grip enhancing means is more concentrated and bounded by the forefinger and middle finger's metacarpophalangeal joints 217 and 220. This grip enhancing means is primarily between these two metacarpophalangeal joints, and does not extend beyond the tip of these two joints in any direction, defining its general boundaries.

These surface areas may include a depression or projection pattern formed from the high friction material, or any other form or structure aforementioned in this specification of course. Formed on the illustrated material is a plurality of triangle-like projections 216, that are applied to select areas of the embodiment by any standard means, as aforementioned. These triangle-like projections preferably are spaced apart to allow for added grip and flexibility.

As discussed, the partially uncovered fingers as well as the aperture along the middle finger segment offer maximum retention of tactile sensation. The uncovered finger portions allow the user to maximize hand coordination, for example, while the aperture allows the user to maintain maximum feel ability on the golf club—both crucial aspects in completing a successful golf swing. Finally and critically important is the added grip provided by the grip enhancing means to support the pinkie finger's grip on the gloved hand.

This unique offering will significantly increase the golfer's ability to control a golf club and also therefore a golf swing and golf ball.

Figure 9:
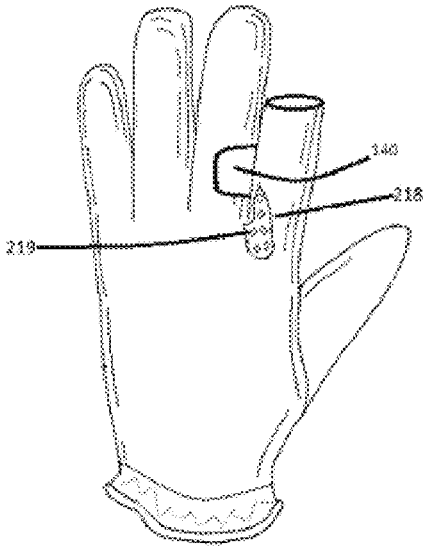
FIG. 9 is an alternative dorsal segment to FIG. 6.

FIG. 9 shows an alternative dorsal segment to FIG. 6. Embodiments may also preferably comprise an aperture 140 along the middle finger, such as on any or all of middle finger's proximal phalanx. This embodiment shows an aperture that resides only on the middle finger's proximal phalanx, thereby defining its terminal edges, but is large enough such that the skin of the middle finger may touch or be touched by the pinkie finger of the dominant hand, for example, while gripping a golf club. As shown, the aperture resides on the dorsal portion of said middle finger proximal phalanx segment leaving uncovered about ninety percent of said dorsal proximal phalanx.

In general, as aforementioned, a grip enhancing means may be either formed on, insert into, or applied to any selected portion for the glove, such as the palm or any thumb or any existing finger stalls, using any standard methods.

This embodiment shows a gripping means comprising of a high friction surface, such as diamond-shaped grooves 219 that are projections on a nitrile surface panel 218, for example, then attaching said panel onto a portion of the gloves dorsal surface area. The bottom portion of the panel is attached to the dorsal surface of the glove by any standard methods of attachment, such as by an adhesive or stitching 218. The panel of this embodiment is placed on the dorsal portion of the forefinger's proximal phalanx segment, extending up to but not including the forefinger's metacarpophalangeal joint.

The strong hand's pinkie finger requires a unique blend of grip and sensitivity capabilities. Providing added grip capabilities along the forefinger's dorsal segment allows a user to better maintain control; providing an aperture along the dorsal segment's proximal phalanx of the middle finger would simultaneously allow the user to maintain tactile sensitivities whereby at least a portion of the middle finger's skin would touch the strong hand.

The materials forming the illustrated embodiments may comprise those discussed in reference to the present invention. Likewise, any previously discussed methods of construction may be applied to this and other embodiments.

FIG. 10 is a drawing of a typical interlocking grip using prior art. As can be seen, the dominant hand's pinkie finger interlocks with the user's weak hand forefinger. The golfer is using a conventional golf glove on the weak hand.

I claim:

1. A glove comprising:

a body comprising a palmar portion, a dorsal portion and a distal lateral edge, wherein the palmar portion and the dorsal portion meet at the distal lateral edge; and a plurality of digital segments projecting from the distal lateral edge of the body, the plurality of digital segments including a middle finger digital segment designed to cover a middle finger;

wherein said middle finger digital segment has a palmar portion and a dorsal portion, a first side adjacent a forefinger and a second side adjacent a ring finger, and wherein said middle finger digital segment is designed to cover a wearer's entire middle finger when the glove is worn; and wherein said plurality of digital segments further comprises a ring finger digital segment that is adapted to enclose an entire ring finger of the wearer and has a dorsal portion and a palmar portion, a digital segment that is adapted to enclose an entire pinkie finger of the wearer and has a dorsal portion and a palmar portion, and a thumb digital segment that is adapted to enclose an entire thumb of the wearer and has a dorsal portion and a palmar portion; and, wherein a forefinger digital segment is designed to leave uncovered the wearer's entire forefinger to have heightened tactile sensitivities; and wherein said glove body dorsal portion is adapted to overlay at least a metacarpophalangeal joint of the wearer's forefinger when the glove is worn;

wherein the glove body dorsal portion overlaying the metacarpophalangeal joint of the wearer's forefinger further comprises of a high friction textured exterior surface formed of a grip enhancing means, whereby said textured surface provides a higher coefficient of friction than a surrounding untextured portion of the glove body;

wherein the ring finger digital segment dorsal portion, the pinkie finger digital segment dorsal portion and the thumb digital segment dorsal portion are completely free of said grip enhancing means.

2. The glove of claim 1, wherein the middle finger digital segment first side further comprises of a high friction textured exterior surface formed of an additional grip enhancing means and is designed to overlay a proximal phalanx of the wearer's middle finger when the glove is worn, whereby said middle finger digital segment second side is free of said grip enhancing means and is thereby untextured;

wherein said textured surface provides a higher coefficient of friction than the untextured portion of the middle finger digital segment when the glove is worn.

3. The glove of claim 1, wherein said glove body dorsal portion is further adapted to overlay at least a metacarpophalangeal joint of the wearer's middle finger and a region between said middle finger metacarpophalangeal joint and said forefinger metacarpophalangeal joint when the glove is worn; and wherein said glove dorsal portion overlaying the region between the forefinger's metacarpophalangeal joint and the middle finger's metacarpophalangeal joint of the wearer's hand further comprises of a high friction textured exterior surface formed of a grip enhancing means, whereby said textured surface provides a higher coefficient of friction than a surrounding untextured portion of the glove body.

4. The glove of claim 1, wherein the dorsal portion of the ring finger digital segment, pinkie finger digital segment and thumb digital segment designed to overlay a distal phalanx of the wearer's middle finger, ring finger and thumb are completely free of said grip enhancing means when the glove is worn.

5. The glove of claim 1, wherein the glove further comprises a terminal edge at the distal lateral edge of the body designed to allow a forefinger to extend past the terminal edge to completely expose the forefinger when the glove is worn, thereby providing a glove without a forefinger digital segment for a forefinger.

6. The glove of claim 1, wherein said grip enhancing means is disposed on and around the metacarpophalangeal joint of the wearer's forefinger but does not extend beyond the forefinger's metacarpophalangeal joint when the glove is worn.

7. The glove of claim 1, wherein said grip enhancing means comprises of a plurality of projections and are designed to provide a higher coefficient of friction on the glove body when the glove is worn.

8. The glove of claim 1, wherein said grip enhancing means further comprises of a panel;

wherein said panel is affixed to said glove body palmar portion.

9. The glove of claim 1, wherein said grip enhancing means comprises a nitrile material, a PVC material, a vinyl material, a rubber material, a neoprene material, or of non-slip materials adapted to provide a high coefficient of friction of approximately two or greater.

10. The glove of claim 1, wherein said grip enhancing means comprises a plurality of depressions.

11. The glove of claim 1, wherein said pinkie digital segment palmar portion further comprises of a grip enhancing means.

12. A glove comprising:

a body comprising a palmar portion, a dorsal portion and a distal lateral edge, wherein the palmar portion and the dorsal portion meet at the distal lateral edge and formed by at least a material; and a plurality of digital segment projecting from the distal lateral edge of the body, the plurality of digital segments including a middle finger digital segment designed to cover a middle finger, wherein said middle finger digital segment has a palmar portion and a dorsal portion, a first side adjacent a forefinger and a second side adjacent a ring finger, and is designed to cover a wearer's entire middle finger when the glove is worn; and wherein said plurality of digital segments further comprises a ring finger digital segment that is adapted to enclose an entire ring finger of the wearer and has a dorsal portion and a palmar portion, a pinkie finger digital segment that is adapted to enclose an entire pinkie finger of the wearer and has a dorsal portion and a palmar portion, and a thumb digital segment that is adapted to enclose an entire thumb of the wearer and has a dorsal portion and a palmar portion; and, wherein a forefinger digital segment is designed to leave uncovered the wearer's entire forefinger to have heightened tactile sensitivities; and wherein said dorsal portion is adapted to overlay all five of a wearer's metacarpophalangeal joints and therebetween when the glove is worn;

wherein glove dorsal portion further comprises of a high friction textured exterior surface formed of a grip enhancing means and is positioned such that said grip enhancing means resides along a region between the wearer's forefinger metacarpophalangeal joint and the middle finger metacarpophalangeal joint;

whereby said textured surface provides a higher coefficient of friction than the surrounding material forming of the glove body; and wherein the ring finger digital segment dorsal portion, the pinkie finger digital segment dorsal portion and the thumb digital segment dorsal portion are completely free of said grip enhancing means.

13. The glove of claim 12, wherein said glove body dorsal portion further comprises of a high friction textured exterior surface formed of a grip enhancing means that is positioned such that said grip enhancing means overlays a metacarpophalangeal joint of the wearer's forefinger when the glove is worn.

14. The glove of claim 12, wherein said glove dorsal portion further comprises of a high friction textured exterior surface formed of a grip enhancing means that is positioned such that said grip enhancing means overlays a metacarpophalangeal joint of the wearer's middle finger when the glove is worn;

wherein said glove body dorsal portion overlaying the dorsal portion of the metacarpophalangeal joint of the wearer's ring finger and pinkie finger are both free of said grip enhancing means when the glove is worn.

15. The glove of claim 12, wherein said glove further comprises a terminal edge at the distal lateral edge of the body designed to allow a forefinger to extend past the terminal edge to completely expose the forefinger when the glove is worn, thereby providing a glove without a digital segment for a forefinger.

16. The glove of claim 12, wherein said thumb digital segment palmar portion further comprises of a grip enhancing means.

17. The glove of claim 12, wherein said glove further comprises of a grip enhancing means comprising of a panel.

18. The glove of claim 12, wherein said palmar portion further comprises of a grip enhancing means comprising of a plurality of projections positioned along the palmar portion of the pinkie finger digital segment.

19. The glove of claim 12, wherein the middle finger digital segment first side further comprises of a high friction textured exterior surface formed of a grip enhancing means and is designed to only overlay a proximal phalanx of the wearer's middle finger when the glove is worn;

wherein said textured surface provides a higher coefficient of friction than the untextured portion of the middle finger digital segment when the glove is worn.

* * * * *